US007730912B2

(12) United States Patent
Blichmann

(10) Patent No.: US 7,730,912 B2
(45) Date of Patent: Jun. 8, 2010

(54) BOTTLE FILLER

(76) Inventor: John Richard Blichmann, 912 Logan Ave., Lafayette, IN (US) 47905

( * ) Notice: Subject to any disclaimer, the term of this patent is extended or adjusted under 35 U.S.C. 154(b) by 982 days.

(21) Appl. No.: 11/496,290

(22) Filed: Jul. 31, 2006

(65) Prior Publication Data

US 2007/0023100 A1 Feb. 1, 2007

(51) Int. Cl.
*B67C 3/26* (2006.01)

(52) U.S. Cl. ..... 141/264; 141/5; 141/64; 141/301; 141/374; 222/523

(58) Field of Classification Search ..... 141/5, 141/6, 63, 64, 285, 301, 392, 264, 374; 222/514, 222/523, 535, 501; 251/325; 53/471
See application file for complete search history.

(56) References Cited

U.S. PATENT DOCUMENTS 2,307,223 A * 1/1943 Kerr ..... 222/442
3,450,175 A 6/1969 Norwood
3,757,835 A 9/1973 Copping
4,151,867 A * 5/1979 Wilhere ..... 141/291
5,150,740 A 9/1992 Yun

OTHER PUBLICATIONS

Foxx Equipment Co. www.foxxequipment.com item #17D03-105.
More Beer www.morebeer.com item #KEG 801.

* cited by examiner

*Primary Examiner*—Gregory L Huson
*Assistant Examiner*—Jason K Niesz

(57) ABSTRACT

An improved bottle filler assembly for filling bottles from kegged carbonated or non carbonated beverages without carbonation loss or oxidation that is intuitive to use, sanitize, and keep free of bacteria. In the preferred embodiment, a long hose gradually reduces the pressure of the beverage on the way to the filler. Two tubes are placed inside each other forming an annulus where $CO_2$ can be forced to the bottom of the bottle via a $CO_2$ valve thereby purging the bottle of air ($O_2$). A valve seat placed on the bottom of the tubes allows the beverage to flow into the bottle from the bottom by depressing a trigger.

18 Claims, 3 Drawing Sheets

Sec A-A

Sec B-B

BOTTLE FILLER

BACKGROUND

1. Field of the Invention

This invention relates generally to bottle filling devices, specifically to bottle filling devices for home made beer and other liquid carbonated beverages.

2. Discussion of Prior Art

It is well known in the home made beer (homebrew) market to utilize a specialized filler to transfer carbonated beer from a pressurized keg into a bottle for portability, gifts, entering into competitions and the like. The alternate to filling from a keg is natural carbonation in the bottle; but this leaves undesirable yeast sediment in the bottom of each bottle. Simply pouring the beer into a bottle from a tap is possible, but too much carbonation is lost from foaming leaving the beer flat. In addition, the presence of oxygen ($O_2$) in the bottle during transfer causes staling of the beer adversely affecting the flavor and shelf life. The common solution to this is a device called a counter-pressure bottle filler (CPBF), which is very common in both the commercial bottling and homebrew industry. A typical homebrew counter-pressure bottle filler is a simplified manual version of the commercial equivalents intended for rapid sequential bottle filling. U.S. Pat. No. 5,150,740 (Yun), U.S. Pat. No. 3,757,835 (Copping), and U.S. Pat. No. 3,450,175 (Norwood) show several commercial high speed fillers. Numerous suppliers such as Foxx Equipment, MoreBeer™ and others manufacture and sell these traditional CPBF fillers. Also, many homebrewers make their own fillers. The typical process to fill a bottle utilizing a homebrew type counter-pressure bottle filler (CPBF) requires a very cumbersome process of turning several valves in a prescribed sequence in order to purge the bottle of air ($O_2$), pressurize the bottle to the same pressure as the keg (to reduce foaming and carbonation loss), turn on the beer flow valve, gradually open the $CO_2$ relief valve to allow beer to flow, turn the beer valve off at the correct fill level, relieve the $CO_2$ pressure in the bottle, and remove the filler assembly, and lastly cap the bottle. If any operations are missed or done in the incorrect order, the bottle could be too foamy (lost carbonation), not at the correct fill level, inadequately purged of air or accidentally sprayed out of the bottle leaving an undesirable mess. The pressurization of the bottle is necessary to prevent foam creation (loss of carbonation) from a sudden pressure change whereby the dissolved $CO_2$ would come out of solution and create foaming. This sudden pressure loss is due to the sharp turns from numerous fittings and elbows, in addition to the throttling nature of valves that would otherwise cause excessive foaming if the bottle was not pressurized prior to filling.

OBJECTS AND ADVANTAGES

Accordingly is an object of this invention to overcome the cumbersome nature of current homebrew counter-pressure bottle fillers.

Yet another object of this invention is to provide a filler that reduces or eliminates sharp bends and valves in the beer flow path.

Yet another object of this invention is to provide a filler that does not require pressurization of the bottle to function.

Yet another object of this invention is to provide a filler that is easy to sanitize.

Yet another object of this invention is to provide a filler that has few cavities for bacteria to collect or mold to grow.

Yet another object of this invention is to provide a filler that is easy to connect and intuitive to use.

DETAILED DESCRIPTION

Figure 3:
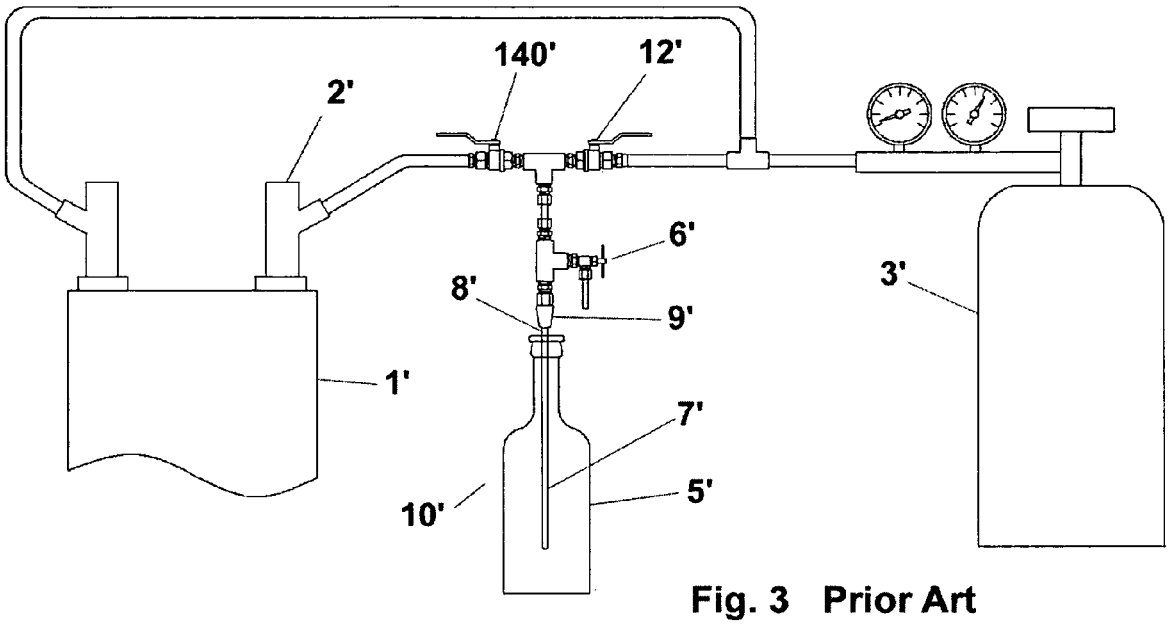
Fig. 3 Prior Art
FIG. 3 is a side view of a Prior Art Counter Pressure Bottle Filler (CPBF).

Referring to prior art FIG. 3, prior art numerical appear as primed numbers (') a common prior art counter-pressure bottle filler (CPBF) 10' is shown. CPBF 10' is comprised of commercially available valves, fittings and tubing. Beer valve 140' is connected to the liquid out 2' on a keg 1'. $CO_2$ valve 12' is connected to $CO_2$ tank 3' which is also connects $CO_2$ to the keg 1'. A bleed valve 6' is connected to a beer stem 7' and also to a $CO_2$ bleed stem 8'. A stopper 9' seals against bottle 5'.

Figure 1:
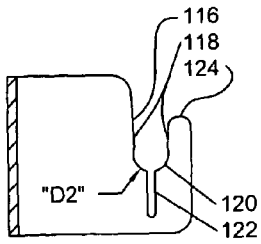
FIG. 1 is a side elevational view of a Bottle Filler Assembly including sections A-A and B-B. Tubes are not shown in section views for clarity.
Figure 1:
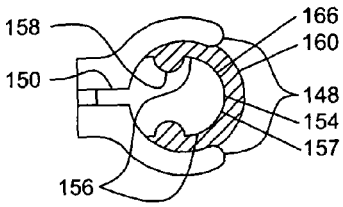
Figure 1:
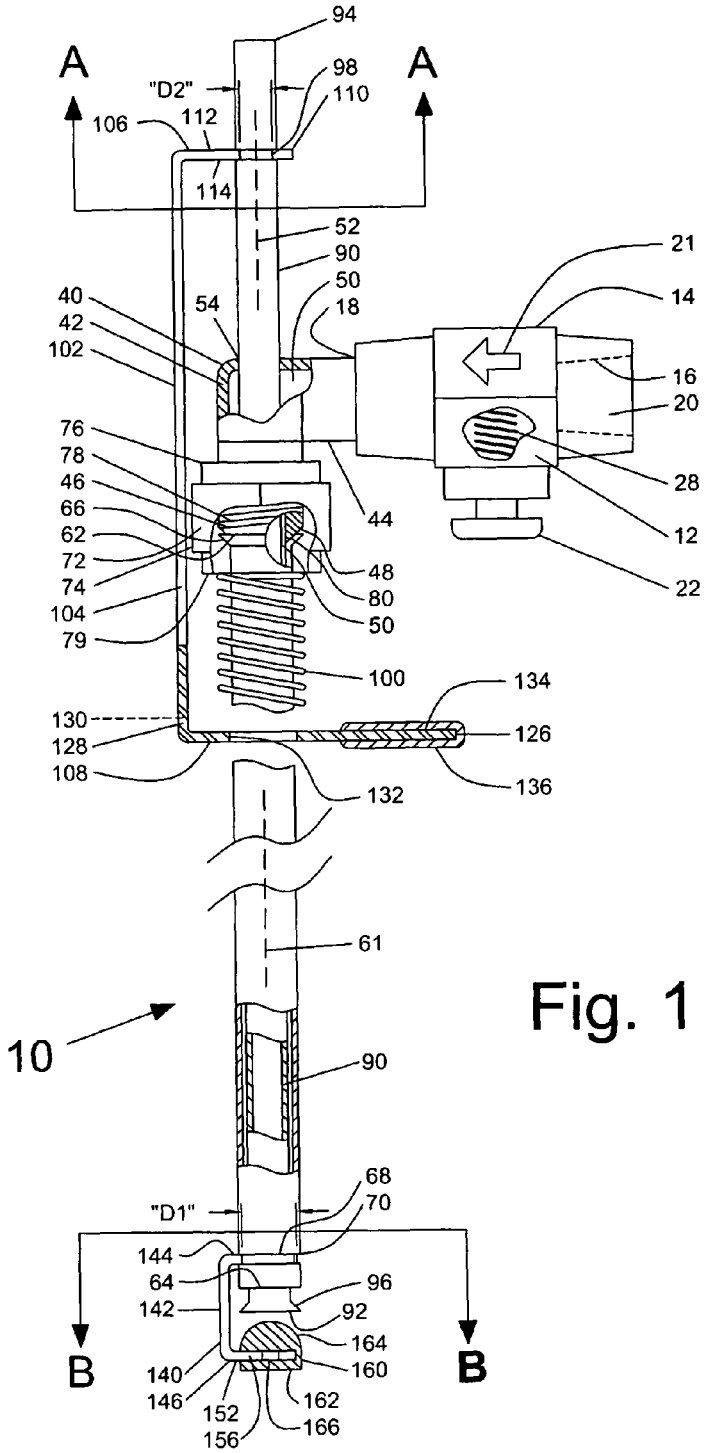
Figure 2:
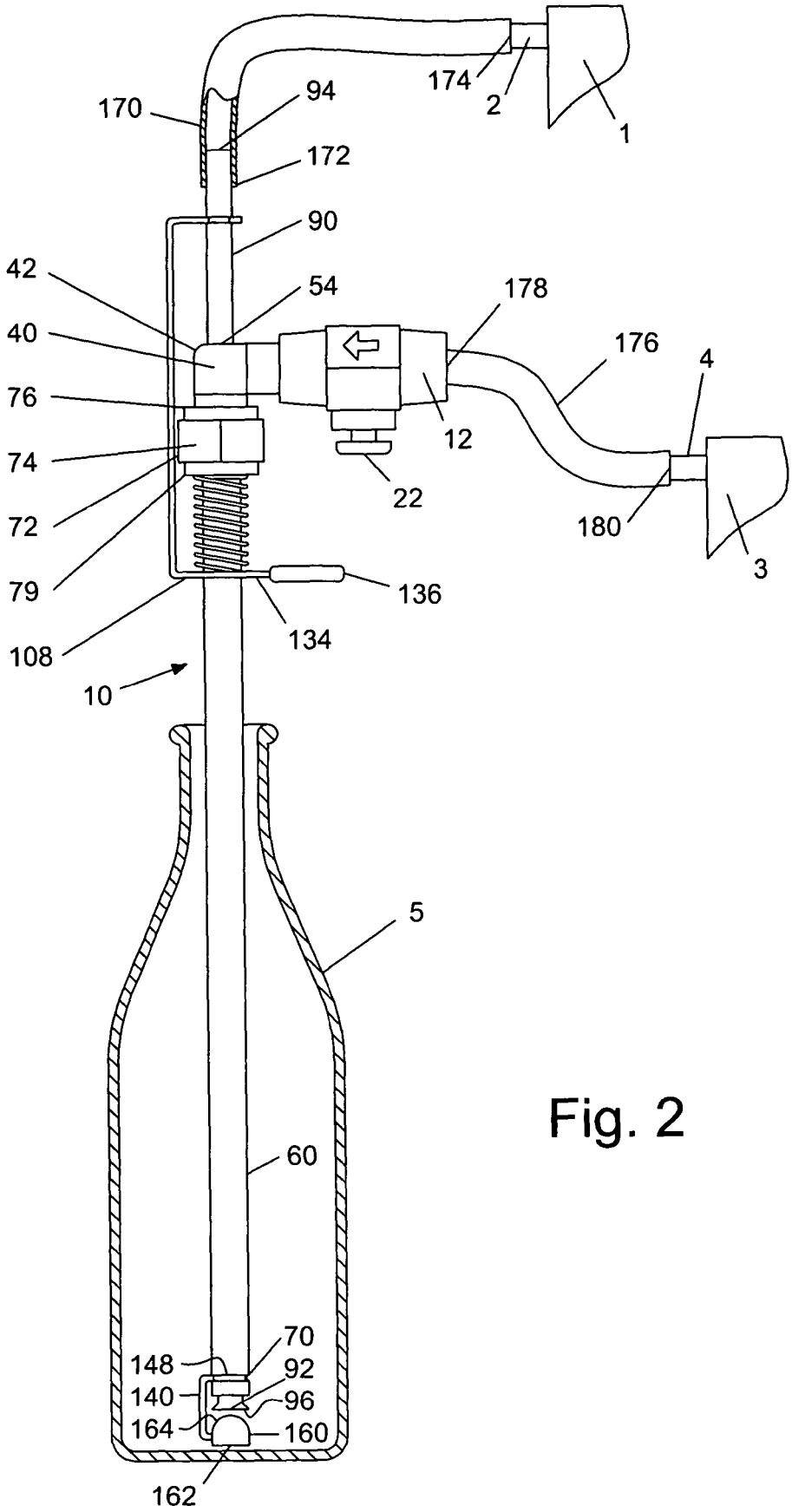
FIG. 2 is a side elevational view of a Bottle Filling Procedure being adapted to fill a bottle.

Referring to FIG. 1 having sections A-A and B-B and FIG. 2, the preferred embodiment is shown. A keg or container 1 of liquid to be drained having an outlet 2, a $CO_2$ tank 3 having an outlet 4 and a bottle 5 are partially shown. A bottle filler assembly 10 is shown. The bottle filler assembly includes a $CO_2$ valve 12 of conventional construction. In this application, the $CO_2$ valve 12 is made of a brass material, but as an alternative could be stainless steel or copper or another material being resistant to corrosion. The $CO_2$ valve has as a body 14 on which are attached a first internally threaded end 16 and a second internally threaded end 18. A passage 20 extends between the first internally threaded end 16 and the second internally threaded end 18. An arrow, designated by reference numeral 21 is cast or engraved on the body 14 and points toward the second internally threaded ends 18. A valve actuator 22 is positioned within the body 14 and the passage 20 between the first internally threaded end 16 and the second threaded end 18 and is movable between an open position, in which a flow can occur within the passage 20 between the first internally threaded end 16 and the second internally threaded end 18, and a closed position in which a flow is prevented from occurring within the passage 20 between the first internally threaded end 16 and the second internally threaded end 18. A biasing means 28, such as a spring maintains the valve actuator 22 in the closed position 26.

Still referring to FIGS. 1 and 2, the bottle filler assembly 10 includes an elbow or fitting 40 having a body 42. In this application, the elbow 40 is made of a brass material, but as an alternative could be stainless steel or copper or another material being resistant to corrosion. The elbow 40 has a first externally threaded end 44 and a second externally threaded end 46 positioned on the body 42 of the elbow 40. The second externally threaded end 46 also has a flared portion 48 thereon. The elbow 40, in this application, has a 90 degree configuration, but as an alternative could be of another configuration such as a 60 or 45 degree angle. A passage 50 extends between the first externally threaded end 44 and the second externally threaded end 46 and follows the configuration of the elbow 40 with a 90 degree configuration. The first externally threaded end 44 is threadedly attached to $CO_2$ valve 12 at the second internally threaded end 18. An axis 52 being perpendicular to the second externally threaded end 46 extends along a portion of the passage 50 in the elbow 40 but remains at a 180 degree angle. A hole or bore 54 is positioned within the body 42, along the axis 52 and extends externally of the body 42 to within the passage 50. The bore 54 has a preestablished size or diameter. In this application, the passage 50 and the bore 54 have similar sizes or diameters.

The bottle assembly 10 includes a first or gas or $CO_2$ tube 60, has a preestablished inside bore or size or diameter formed about an axis 61, a preestablished outside size or diameter, and a length extending between a first end 62 and a second end 64. In this application, the first tube 60 is made of a stainless steel material, but as an alternative could be brass or copper or another material being resistant to corrosion. The first end 62 of the first tube 60 has a flared portion 66 positioned thereon and the second end 64 has a seat portion 68 positioned thereon. Spaced a preestablished distance from the second end 64 is a groove 70. The groove 70 has a preestablished width and depth. The depth of the groove 70 forms a preestablished diameter "D1" about the first tube 60. A nut 72 is also a part of the bottle filler assembly 10. The nut 72 has an external surface 74, which in this application has a hexagonal configuration, but as an alternative could be square or include a serrated surface. A first end 76 of the nut 72 has an internally threaded portion 78 and a second end 79 of the nut 72 has a sealing portion 80 formed thereon. The nut 72 is positioned on the first tube 60. As the nut 72 is tightened, the sealing portion 80 of the nut 72 is sealingly connected with the flared portion 66 of the first tube 60 and the flared portion 66 of the tube is sealingly connected with the flared portion 48 of the elbow 40 by tightening the internally threaded portion 78 of the nut 72 with the second externally threaded end 18 of the elbow 40.

A second or liquid or beer tube 90 is included in the bottle filler assembly 10. The second tube 90 is made of a stainless steel material, but as an alternative could be brass or copper or another material being resistant to corrosion. The second tube 90 has a preestablished inside bore, size or diameter, a preestablished outside size or diameter, and a preestablished length extending between a first end 92 and a second end 94. The preestablished outside size or diameter slidably fits within the preestablished inside bore, size or diameter of the first tube 60. And, the preestablished outside size or diameter of the second tube 90 slidably and sealingly fits within the bore or hole 54 of the elbow 40. The first end 92 of the second tube 90 has a flared portion 96 thereon. A groove 98 is spaced a preestablished distance from the second end 94 of the second tube 90 and is interposed the first and second ends 92, 94. The groove 98 has a preestablished width and depth. The preestablished depth of the groove 98 forms a preestablished diameter "D2" about the second tube 90. The second end 94 of the second tube 90 is positioned within the second end 64 of the first tube 60, slid along the inside bore or diameter, slid along the axis 52 and through the bore or hole 54 of the elbow 40 until the groove 98 extends beyond the body 42 of the elbow 40.

The bottle filler assembly 10 includes a spring or biasing means 100 and a trigger mechanism 102. The spring 100 and the trigger mechanism 102 is made of stainless steel, but as an alternative, at least the trigger mechanism 102, could be brass or copper or another material being resistant to corrosion. The spring 100 has a preestablished inside diameter which slidably attaches over the preestablished size or diameter of the first tube 60, and a preestablished spring rate. The spring 100 has a preestablished length. The trigger mechanism has a generally "U" shaped configuration including a base member 104, a first end member 106 and a second end member 108. The base member 104 has a rectangular configuration and includes a length and a width. The length of the base member 104 is greater that the length of the spring 100 and the width of the base member 104 is greater than or about twice that of the size or diameter of the first tube 60. The first end member 106 extends at a 90 degree angle from the base member 104 and has an end 110 which extends from the base a preestablished distance. The first end member 106 includes a first side 112 and a second side 114. A slot 116 extends from the first side 112 and is positioned a preestablished distance from the end 110. The slot 116 include a pair of angling side members 118 extending from the first side 112 and terminating within a cylindrical portion 120. The cylindrical portion 120 has a size or diameter being substantially identical to the size or diameter "D2" of the groove 98 in the second tube 90. The cylindrical portion 120 is positioned about a center and is formed by a radius forming a circumference. The center is spaced from the base member 104 a preestablished distance. The pair of angling side members 118 intersect the circumference of the cylindrical portion 120 and the intersection thereof forms a circumference being greater than 180 degrees. Extending from the circumference toward the second side 114 is a notch 122. The notch 122 has a preestablished width and length. The notch 122 is spaced from the second side 114 a preestablished distance. A portion of the first end member 106 interposed the first side 112 and one of the pair of angling side members 118 has been removed. A radiused portion 124 extends between one of the pair of angling side member 118 and the end 110. The second end member 108 of the trigger mechanism 102 extends at a 90 degree angle from the base member 104 and has an end 126. The second end member 108 includes a first side 128 and a second side 130. Positioned in the second end member 108 is a bore 132. The bore 132 is spaced from the base a distance being substantially equal to the preestablished distance the center of the circumference of the cylindrical portion 120 is spaced from the base member 104. Extending from the end 126 toward the base member 104 is a trigger portion 134. The trigger portion 134 is necked down from the first side 128 and the second side 130; however, as an alternative the trigger need not be necked down. An anti-slip covering 136 is formed about the trigger portion 134. With the slot 116 of the first end 106 pointed toward the nut 72, the bore 132 of the trigger mechanism 102 is positioned over the preestablished size or diameter of the first tube 60 and the trigger mechanism 102 is slid toward the nut 72.

The bottle filling mechanism 10 further includes a sealing mechanism or beer valve assembly 140. The sealing mechanism 140 has a generally "U" shaped configuration. The sealing mechanism 140 has a base portion 142 having a first end 144 and a second end 146 positioned within a width. A pair of fingers 148 extends from the first end 144 at a 90 degree angle. The pair of fingers 148 have an accurate configuration and are formed to define a cylindrical circumference having a preestablished diameter being substantially equal to the preestablished diameter "D1" about the first tube 60. A slit 150 is interposed the pair of fingers 148 and extends from the first end 144 toward the second end 146 of the base portion 142 a preestablished distance. The slit 150 is positioned generally equally spaced within the width of the base portion 142. An attaching end 152 extends from the second end 146 at a 90 degree angle. The attaching end 152 has an end 154 and a pair of sides 156. The end 154 has a radiused portion 157 and the pair of sides 156 each have a notch 158 therein. The radiused portion 156 and the notch 158 in each of the pair of sides 156 are positioned from the second end 146 of the base portion 142 a preestablished distance. Each of the base portion 142, the pair of fingers 148 and the attaching end 152 is made of a stainless steel material, but as an alternative could be brass or copper or another material being resistant to corrosion. A seal member 160 is made of a silicone material, but could be of an alternative sealing material, and is attached to the end 154. The seal member 160 has a flat end 162 and a spherical end 164. A recess 166 is formed intermediate the flat end 162 and the spherical end 164. The recess 166 is positioned about the radiused portion 156 and the notches 158 securing the seal member 160 to the attaching end 152 in a prefixed relationship. With the flared portion 96 of the second tube 90 in contact with the second end 64 of the first tube 60, the sealing mechanism 140 is attached within the bottle filler assembly 10. The pair of fingers 148 are positioned within the groove 70 of the first tube 60 and the sealing member 160 is precisely locate to be capable of being in sealing relationship with the flared portion 96 of the second tube 90.

The bottle filling assembly 10 will require a first or beer hose 170, has a preestablished inner diameter being about the same or about the equivalent of the preestablished outside size or diameter of the second tube 90 and has a preestablished length. The first hose 170 has a first end 172 which is attached to the second end 94 of the second tube 90 and extends over and past the second end 90. A second end 174 of the first hose is attached to the outlet 2 of the keg 1 in a conventional manner. A second or $CO_2$ hose 176 has a preestablished inner diameter and length. The second hose 176 has a first end 178 connected to the first internally threaded end 16 of the $CO_2$ valve 12 in a conventional manner. A second end 180 of the second hose 176 is connected to the $CO_2$ tank 3 in a conventional manner.

Many ramifications of the invention are possible. For example, a ball valve, foot operated valve, or other style of valve can be used in lieu of the push valve used for the $CO_2$ valve 12 as shown in the drawings. In lieu of elbow 40, a "Tee" could be used with a close fitting hole in a cap nut, or compression ferrule to seal against beer tube 90 and still provide sufficient clearance for free movement of beer tube 90. Numerous fitting types and combinations are possible in lieu of flare type fittings such as ferrule type compression fittings and pipe threads which accomplish the same functionality. Also, many ramifications of the beer valve seating geometry are possible to adequately seal and provide a non turbulent flow of the beer such as cones, bugle shapes, o-ring and similar. The beer valve assembly 140 and trigger mechanism 102 can also be fastened to their respective tubes via numerous means such as welding, clamping, interference fits etc., or incorporated as an integral part of the tube. Yet another method would be to employ a mechanism similar to existing "push-type" bottle fillers, well known in the art, in lieu of the aforementioned beer valve assembly 140. This would be used in conjunction with the $CO_2$ tube 60 to add the $CO_2$ bottle purging feature. It is also possible to install a small seltzer bottle $CO_2$ cartridge on $CO_2$ valve 12 in lieu of the second or $CO_2$ hose 176 from a larger $CO_2$ tank typically used in beer dispensing. Often, these $CO_2$ seltzer type assemblies include a valve and pressure reducing mechanism wherein $CO_2$ valve 12 can be eliminated. In addition to $CO_2$, it is also possible to use other commonly acceptable purging gasses such as $N_2$ or argon etc. The filler can be used with either a carbonated or non carbonated liquid. When using with a carbonated liquid, the length of hose between the keg and the filler should be increased, about 10 feet in length, to reduce undesirable foaming. Lastly, it is possible to use this filler for other fluids such as wine, beverages, or chemicals where purging of the container is desirable prior to filling.

INDUSTRIAL APPLICABILITY

Referring to the prior art drawing of FIG. 3, the prior art CPBF operation is very complicated and not at all intuitive as mentioned earlier. After connecting CPBF 10' to keg 1' and $CO_2$ tank 3', CPBF 10' is inserted into bottle 5'. Stopper 9' is firmly placed on a lip of bottle 5'. $CO_2$ valve 12' is opened to allow $CO_2$ to fill bottle 5' through beer stem 7'. Since $CO_2$ is heavier than air, it stays at the bottom of the bottle 5'. Bleed valve 6' is then opened to allow air to escape through vent tube 8' and out of bleed valve 6'. Bleed valve 6' is then closed to allow bottle 5' to pressurize to the same pressure as keg 1'. When $CO_2$ stops flowing, bottle 5' and keg 1' are now at the same pressure and $CO_2$ valve 12' is then closed. Beer valve 140' is then opened, but will not flow since no pressure differential exists from keg 1' to bottle 5'. To allow beer to enter bottle 5', bleed valve 6' is then slightly opened to gradually reduce pressure in bottle 5'. Beer will begin to slowly fill the bottle 5'. Since the bottle 5' and the keg 1' are at nearly the same pressure little foaming (carbonation loss) will be experienced. When the bottle 5' is close to full, beer valve 140' is closed. When bleed valve 6' has fully released the remaining $CO_2$ pressure, the filler 7' is removed from bottle 5' and capped. If any of the numerous above steps are missed or done in an incorrect sequence, excessive foaming, oxidation of the beer, or explosive spraying of beer from the bottle 5' can occur.

Referring to FIGS. 1 and 2, the preferred embodiment of the invention is shown. The bottle filling assembly 10 is assembled as follows. The first externally threaded end 44 of the elbow 40 is threadedly attached to the second internally threaded end 18 of the $CO_2$ valve 12. Thus, with the arrow 21 points toward the elbow 40, the elbow 40 and the $CO_2$ valve 12 are securely tightened. The nut 72 is placed over the seat portion 66 of the first tube 60 and the sealing portion 80 of the nut 72 is slid into contact with the flared portion 66 of the first tube 60. The internal threaded portion 78 of the nut 72 is threadedly engaged with the second externally threaded end 46 of the elbow 40. With the axis 52 of the bore 54 and passage 50 coinciding with the axis 61 of the first tube, the nut 72 and the elbow 40 are hand tightened causing the seat portion 66 of the first tube 60 to contact the flared portion 48 of the elbow 40 and the sealing portion 80 of the nut 72 to contact the seat portion 66 of the first tube 60. Next, the second end 94, having the groove 98 thereon, of the second tube 90 is inserted within the preestablished inside bore of the second end 64 of the first tube 60. The second end 94 is slid along the inner bore, within the passage 50 and into the bore 54 within the elbow 40. The second tube 90 is extended through the bore 54 until the groove 98 extends beyond the body 42 of the elbow 40. At this time the nut 72 is secured snugly onto the elbow 40. With the nut 72 snugly fitted the second tube 90 should slide freely within the bore 54 and the inner bore of the first tube 60. Now, slide the inside diameter of the spring 100 over the second end 64 and the preestablished outside diameter of the first tube 60 until the spring 100 contacts the second end 79 of the nut 72. Slide the bore 132 of the second end member 108 of the trigger mechanism 102 over the second end 64 of the first tube 60 with the first end member 106, having the slot 116, pointing toward the nut 72. Extend the slot 116 past the elbow 40 and with the groove 98 extended beyond the body 42 of the elbow 40 press the angling side members 118 into the groove 98 and snap the cylindrical portion 120 into the groove 98. The circumference of the cylindrical portion 120 and preestablished diameter "D2" should form a tight rather rigid connection. With the seal member 160 positioned on the attaching end 152 of the sealing mechanism 140, position the seal member 160 in contact with the flared portion 96 at the first end 92 of the second tube 90. Press the sealing mechanism 140 and the first end 92 of the second tube 90 toward the nut 72 until the pair of fingers 148 are aligned with the groove 70 and snap the preestablished diameter of the cylindrical circumference onto the preestablished diameter "D1" of the groove 70. The cylindrical circumference of the pair of fingers 148 and the preestablished diameter "D1" should form a tight rather rigid connection keeping the seal member 160 aligned with the flared portion 96 of the second tube 90 forming a seal therebetween.

Prior to operation, the bottle filling assembly 10 is connected as follows. Attach the first end 172 of the first hose 170 to the second end 94 of the second tube 90. Do not place the first end 172 of the first hose 170 more than ⅜ of an inch past the second end 94. Attach the second end 174 of the first hose to the outlet 2 of the keg 1 in a conventional manner. Placing the first hose 170 further on the second tube 90 makes disassembly more difficult. Connect the first end 178 of the second hose 176 to the first internally threaded end 16 of the $CO_2$ valve 12 in a conventional manner. And, connect the second end 180 of the second hose 176 to the $CO_2$ tank 3 in a conventional manner. And, place the sealing mechanism 140, the second end 62 of the first tube 60 and the flared portion 96 of the second tube 90 within the bottle 5 until the sealing member 140 contact a bottom of the bottle 5 to be filled.

In operation, with the second hose 176 affixed to $CO_2$ valve 12 of bottle filler assembly 10 the pressure in the keg 1 should approximately ½ that of the dispensing pressure (about 4-8 PSI). An external pressurizing device may be require to apply such a pressure to the keg. The second hose 176 is interposed the second tube 90 and the outlet 2 of the keg 1 and experimentation has shown that the long length of hose (approximately 1 Oft) of small diameter hose (approximately 3⁄32" ID) will reduce the pressure gradually from line restriction and minimize foaming, although other lengths and diameters may provide satisfactory results. The valve actuator 22 is depressed moving the $CO_2$ valve 12 into an open position 24 in which a flow of $CO_2$ occurs. After several seconds the oxygen or air in the bottle is purged by $CO_2$ gas filling the bottle 5 with $CO_2$. Since no stopper 9' or bleed valve 6' is utilized in this embodiment, the oxygen or air naturally flows out of the top of bottle 5 with no intervention. The trigger mechanism 102 is then quickly actuated allowing beer (wine, soda or other product) to flow into the bottle 5. In actuality, the trigger portion 134 is moved toward the nut 72 and the spring 100 is compressed. The cylindrical portion 120 within the groove 98 cause the flared portion 96 of the second tube 90 to move away from the spherical end 164 of the seal member 160, unseating the sealing mechanism 140 and allowing a flow of beer to occur. When the bottle 5 is completely full, trigger mechanism 102 is then quickly released stopping the flow of beer. The bottle filler assembly 10 is then removed from the bottle 5. The volume displaced by the bottle filler assembly creates an ideal bottle fill level (head space). With sealing mechanism 140 placed mid-way into the remaining head space, $CO_2$ valve 12 is momentarily depressed to clear any oxygen from the head space, providing a completely oxygen free bottle. The bottle 5 is then capped.

To clean the bottle filler assembly, simply disassemble and soak in sanitizing solution, no scrubbing or brushing is required. Since no valves or fittings with interstitial cavities are exposed to the beer, contamination from bacteria and mold are all but eliminated.

SUMMARY, RAMIFICATIONS, AND SCOPE

Thus the reader will see that the improved bottle filler assembly provides an extremely intuitive, simple method to fill bottles with little foaming or oxidation. The bottle filler assembly is also very simple to clean, assemble and sanitize. Once connected, one actuator or button is pressed for $CO_2$ purge, and a second trigger mechanism is pressed for bottle fill, so the operation is very simple and intuitive. The lack of sharp turns and throttling type valves in the present invention eliminates these sources of foaming. The long length of hose gradually reduces the beer pressure, also reducing foaming. In addition, eliminating the need to pressurize the bottle forgoes the complicated valves, fittings and stoppers that complicate the operation and introduces areas of possible bacterial contamination. While my description contains many specificities, these should not be construed as limitations of the scope of the invention, but rather as an exemplification of one preferred embodiment thereof.

LIST OF DRAWING NUMERALS

1 Keg
2 Outlet—Keg
3 Tank—$CO_2$
4 Outlet—$CO_2$ Tank
5 Bottle
6' Bleed Valve
7' Beer Stem
8' $CO_2$ Bleed Stem
9' Stopper
10 Bottle Filler Assembly
12 $CO_2$ Valve—Bottle Filler Assembly
14 Body—$CO_2$ Valve
16 First Internally Threaded End—$CO_2$ Valve
18 Second Internally Threaded End—$CO_2$ Valve
20 Passage—$CO_2$ Valve
21 Arrow—Reference Numeral
22 Valve Actuator—$CO_2$ Valve
24
26
28 Biasing Means—Valve Acturator
30
32
34
36
38
40 Elbow—Bottle Filler Assembly
42 Body—Elbow
44 First Externally Threaded End—Elbow
46 Second Externally Threaded End—Elbow
48 Flared Portion—Second Externally Threaded End
50 Passage—Elbow
52 Axis—Second Externally Threaded End
54 Bore—Body
56
58
60 First Tube—$CO_2$
61 Axis—First Tube
62 First End—First Tube
64 Second End—First Tube
66 Flared Portion—First End of First Tube
68 Seat Portion—Second End of First Tube
70 Groove—Second End of First Tube
72 Nut
74 External Surface—Nut
76 First End—Nut

78 Internally Threaded Portion—First End
79 Second End—Nut
80 Sealing Portion—Second End
82
84
86
88
90 Second Tube—Beer
92 First End—Second Tube
94 Second End—Second Tube
96 Flared Portion—First End of Second Tube
98 Groove—Second End of Second Tube
100 Spring—Bottle Filler Assembly
102 Trigger Mechanism—Bottle Filler Assembly
104 Base Member—Trigger Mechanism
106 First End Member—Trigger Mechanism
108 Second End Member—Trigger Mechanism
110 End—Base Member
112 First Side—Base Member
114 Second Side—Base Member
116 Slot—First End Member
118 Pair of Angling Side Members—First End Member
120 Cylindrical Portion—First End Member
122 Notch—First End Member
124 Radiused Portion—First End Member
126 End—Second End Member
128 First Side—Second End Member
130 Second Side—Second End Member
132 Bore—Second End Member
134 Trigger Portion—Second End Member
136 Anti-slip Covering—Trigger Portion
138
140 Sealing Mechanism—Beer Valve Assembly
142 Base Portion—Sealing Mechanism
144 First End—Base Portion
146 Second End—Base Portion
148 Pair of Fingers—Sealing Mechanism
150 Slit—Sealing Mechanism
152 Attaching End—Sealing Mechanism
154 End—Attaching End
156 Pair of Sides—Attaching End
157 Radiused Portion—Attaching End
158 Notch—Attaching End
160 Seal Member—Sealing Mechanism
162 Flat End—Seal Member
164 Spherical End—Seal Member
166 Recess—Seal Member
168
170 First Hose—Beer
172 First End—First Hose
174 Second End—First Hose
176 Second Hose—$CO_2$
178 First End—Second Hose
180 Second End—Second Hose

I claim:

1. A bottle filler assembly being adapted to dispense a liquid from a pressurized container into a non-pressurized container, said bottle filler assembly comprising:

a valve having a first end and a second end, a passage interposed said first end of said valve and said second end of said valve, and a valve actuator interposed said passage, said valve actuator being movable between an open position allowing a flow in said passage between said first end of said valve and said second end of said valve and a closed position preventing a flow in said passage between said first end of said valve and said second end of said valve;

a fitting defining a body, having a first end of said fitting and a second end, said first end of said fitting being connected to said second end of said valve, a passage interposed said first end of said fitting and said second end of said fitting, an axis being perpendicular to said second end of said valve and extending along at least a portion of said passage, a bore having a preestablished diameter being positioned in said body, along said axis and extending externally of said body and into said passage within said fitting;

a first tube having a preestablished inside diameter formed about an axis and an outside diameter, a first end and a second end, said first end of said first tube being connected to said second end of said fitting, said axis of said inside diameter coinciding with said axis of said bore in said fitting;

a second tube having a preestablished outside diameter and an inside diameter, a first end and a second end, said second tube being partially positioned within said preestablished inside diameter of said first tube, being partially positioned within said passage within said fitting and being partially positioned within said bore in said fitting, said second tube being slidably positioned in said first tube, said passage within said fitting and said bore in said fitting, said second tube being sealingly positioned in said bore in said fitting, said first end of said second tube extends beyond said second end of said first tube and said second end of said second tube extend beyond said body of said fitting;

a trigger mechanism has a first end and a second end, said first end of said trigger mechanism being attached to said second tube near said second end of said second tube and said second end of said trigger mechanism having a trigger portion;

a sealing mechanism has an attaching end being attached near the second end of said first tube and a seal member extending beyond the second end of said first tube, said sealing member being precisely located to be capable of being in sealing relationship with said second tube; and a biasing means for sealingly maintaining said sealing member in sealing relationship with said second tube and said trigger mechanism being in capable of unseating said sealing relationship of said sealing member and said second tube.

2. The bottle filling assembly of claim 1 wherein said first end and said second end of said fitting are positioned at a 90 degree angle from each other.

3. The bottle filling assembly of claim 1 wherein said first end of said first tube includes a flared portion and said second end of said fitting includes an externally threaded end and a flared portion.

4. The bottle filling assembly of claim 3 wherein a nut is attached to said externally threaded end and connects said first tube to said fitting.

5. The bottle filling assembly of claim 1 wherein said first end of said second tube has a flared portion and said sealing member has a spherical end.

6. The bottle filling assembly of claim 1 wherein said trigger mechanism is removably attached to said second tube and said sealing mechanism is removably attached to said first tube.

7. The bottle filling assembly of claim 1 wherein said trigger mechanism includes a first end member attached to said second tube and a second end member slidably positioned about said first tube.

8. The bottle filling assembly of claim 7 wherein said first end member is removably attached to said second tube, said second tube has a groove therein and said first end member has a slot and a radiused portion, said radiused portion being positioned within said groove.

9. The bottle filling assembly of claim 1 wherein said sealing member is removably attached to said sealing mechanism.

10. The bottle filling assembly of claim 1 wherein said valve and said fitting are made from a non-corrosive material such as brass.

11. The bottle filling assembly of claim 1 wherein said first tube, said second tube and said trigger mechanism are made from a non-corrosive material such as stainless steel.

12. The bottle filling assembly of claim 1 wherein said seal member is made from a silicone material.

13. The bottle filling assembly of claim 1 wherein said valve, said fitting, said first tube, said second tube, said trigger mechanism, said sealing mechanism and said biasing means are removably attached.

14. The bottle filling assembly of claim 1 wherein said sealing mechanism includes a sealing member being replaceable.

15. A method of dispensing a liquid from a pressurized container to a non-pressurized container such as a bottle having an open end using a bottle filler assembly, said bottle filler assembly having a valve having an actuator therein being movable between an open position and a closed position, a first tube having a sealing mechanism attached to an end and a second tube having a first end and a second end, said second tube being slidably positioned within said first tube, said second end being sealingly engaged with said sealing mechanism and a trigger mechanism for moving said second end of said second tube into an unseated relationship with said sealing mechanism comprising the steps of:

attaching a first end of a first hose to said pressurized container;

attaching a second end of said first hose to said first end of said second tube;

attaching a first end of a second hose to a source of $CO_2$;

attaching a second end of said second hose to said valve;

positioning said bottle filler assembly loosely through said open end of said bottle to be filled;

positioning said second end of said second tube at or near a bottom of said bottle;

engaging said actuator causing a flow of $CO_2$ into said bottle;

evacuating a contents of said bottle through said open end and filling said bottle with $CO_2$;

disengaging said actuator preventing a flow of $CO_2$;

engaging said trigger mechanism unseating said sealing mechanism and said second tube dispensing said carbonated liquid from said pressurized container to said bottle;

disengaging said trigger mechanism preventing a flow of said carbonated liquid;

removing said second end of said second tube from said bottle; and sealing said bottle.

16. The method of dispensing a liquid from a pressurized container to a non-pressurized container of claim 15 wherein said step of removing said second end of said second tube from said bottle includes the steps of:

removing second end of said second tube from said carbonated liquid;

engaging said actuator causing a flow of $CO_2$ into said bottle; and removing said second end of said second tube from said bottle.

17. The method of dispensing a liquid from a pressurized container to a non-pressurized container of claim 15 wherein a seal is not formed between said first tube and said open end of said bottle.

18. The method of dispensing a liquid from a pressurized container to a non-pressurized container of claim 15 wherein said steps of engaging said actuator causing a flow of $CO_2$ into said bottle; disengaging said actuator preventing a flow of $CO_2$; engaging said trigger mechanism unseating said sealing mechanism and said second tube dispensing said carbonated liquid from said pressurized container to said bottle; and disengaging said trigger mechanism preventing a flow of said carbonated liquid are independent manual operations.

* * * * *